US009449561B1

(12) United States Patent
Umansky et al.

(10) Patent No.: US 9,449,561 B1
(45) Date of Patent: Sep. 20, 2016

(54) LIGHT SENSOR OBSTRUCTION DETECTION

(71) Applicant: Amazon Technologies, Inc., Reno, NV (US)

(72) Inventors: Ilya Umansky, San Jose, CA (US); Ilya Vladimirovich Brailovskiy, Mountain View, CA (US)

(73) Assignee: Amazon Technologies, Inc., Seattle, WA (US)

( * ) Notice: Subject to any disclaimer, the term of this patent is extended or adjusted under 35 U.S.C. 154(b) by 168 days.

(21) Appl. No.: 14/308,465

(22) Filed: Jun. 18, 2014

(51) Int. Cl.
*G09G 5/10* (2006.01)
*G09G 3/34* (2006.01)

(52) U.S. Cl.
CPC .... *G09G 3/3406* (2013.01); *G09G 2320/0626* (2013.01)

(58) Field of Classification Search
CPC ..... G09G 2360/144; G09G 3/3406; G09G 2320/0626
USPC ..... 345/690
See application file for complete search history.

(56) References Cited

U.S. PATENT DOCUMENTS

2010/0141571 A1* 6/2010 Chiang ..... G09G 3/20 345/102
2012/0050189 A1* 3/2012 Choboter ..... H04M 1/72577 345/173
2013/0076712 A1* 3/2013 Zheng ..... G01J 1/32 345/207
2013/0147855 A1* 6/2013 Wang ..... G09G 3/20 345/690
2013/0231161 A1* 9/2013 Hsu ..... G09G 3/3406 455/566
2013/0328842 A1* 12/2013 Barnhoefer ..... G09G 3/3406 345/207
2014/0022378 A1* 1/2014 Higgins-Luthman ..... B60R 1/00 348/113

* cited by examiner

*Primary Examiner* — Jonathan Boyd
(74) *Attorney, Agent, or Firm* — Lee & Hayes, PLLC

(57) ABSTRACT

An ambient light sensor may be used to measure ambient light in an environment that surrounds a device. The measured ambient light may be used to adjust display settings employed by the device, and thereby improve a user experience during interaction with the device in the environment. During use of the device that includes an ambient light sensor, the ambient light sensor may become obscured (blocked, covered, etc.) by a user's finger, a cover, dirt, and/or by another object that obstructs the ambient light sensor's ability to detect light from the environment. Various techniques may be used to determine obstruction of the ambient light sensor. In some embodiments, changes in display settings may be compared to measured changes in ambient light to determine whether a light sensor is obstructed. In some embodiments, use of a second light sensor may validate whether a first light sensor is obstructed.

16 Claims, 9 Drawing Sheets

LIGHT SENSOR OBSTRUCTION DETECTION

BACKGROUND

Ambient light sensors are often deployed with electronic devices to measure ambient light. The electronic device may then modify a presentation of content based on the measured amount of ambient light, such as by adjusting display attributes/settings (e.g., pixel color levels, gamma and color gamut, etc.) and/or lighting attributes/settings (front light intensity, back light intensity, etc.) of the electronic device. A typical ambient light sensor collects luminosity information of the current environment. To accomplish collection of the luminosity information, the ambient light sensor requires an unobstructed view of the environment. Typically, ambient light sensors have an optical channel connected to a window (lens, etc.) that enables optical detection of the environment. When the window of the ambient light sensor is obscured (blocked, covered, etc.), then the ambient light sensor cannot provide accurate luminosity information for the environment, but will instead report incorrect luminosity information due to the blockage. Incorrect luminosity information could result in a poor use experience, unnecessary use of power, or other undesirable effects.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
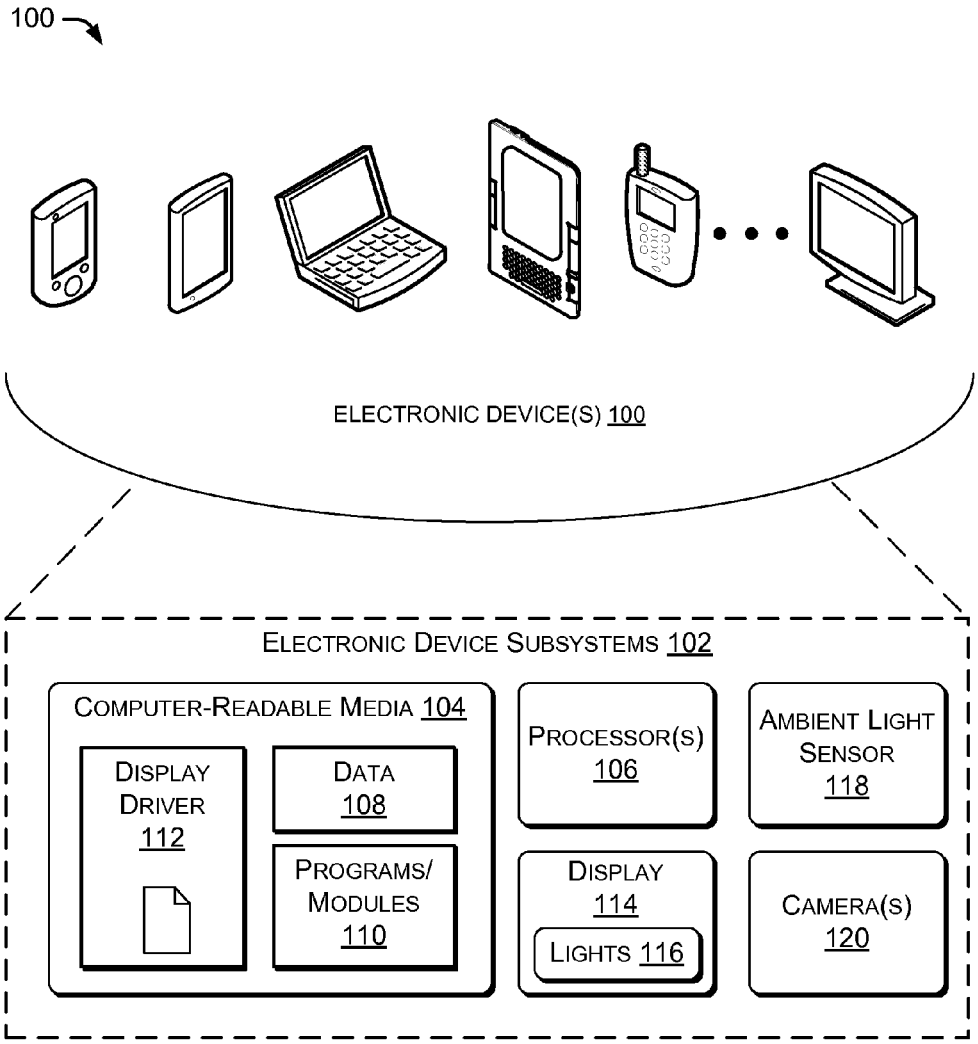
FIG. 1 is a schematic diagram of an illustrative electronic device usable to detect obstruction of a light sensor.

This disclosure is directed to measurement of light by a light sensor to enable collection of luminosity information.

An ambient light sensor may be used to measure ambient light in an environment that surrounds an electronic device. The measured ambient light may be used to adjust display settings employed by the electronic device, and thereby improve a user experience during interaction with the electronic device in the environment. During use of an electronic device that includes an ambient light sensor, the ambient light sensor may become obscured (blocked, covered, etc.) by a user's finger, a case or cover of the electronic device, dirt, a shadow, and/or by another object that obstructs the ambient light sensor's ability to detect light from the environment. As disclosed herein, various techniques may be used to determine obstruction of the ambient light sensor. As used herein, the term "obstructed" (including variances of this word) is intended to mean fully or partially "blocked" and/or "covered," whereby an amount of light received by a light sensor is hindered by an object in close proximity to the light sensor, such as a finger, device case, device cover, device accessory, piece of paper, dirt, shadow, or other object that is touching the light sensor or is near the light sensor while at least a portion of the display is not obstructed from the object.

In some embodiments, an ambient light sensor may obtain a first measurement of ambient light while a display setting uses a first display output setting. The display settings may include one or both of display attributes/settings (e.g., pixel color levels, gamma and color gamut, etc.) and/or lighting attributes/settings (front light intensity, back light intensity, etc.). The display setting may then be adjusted, at least partially, based on the first measurement of the ambient light to create a second display output setting. The ambient light sensor may then obtain a second measurement of the ambient light after performing the adjustment of the display setting to the second display output setting. When the second measurement is outside of an anticipated range of expected measurement values based on the second display output setting, then the ambient light sensor may be determined to be obscured and the display output setting may be reverted, at least temporarily, back to the first display output setting.

In various embodiments, the ambient light sensor may be determined to be obstructed in response to a determination that an actual display output of light is greater than expected (e.g., greater than a threshold value) based on an amount of light measured by the ambient light sensor. In other words, if the ambient light sensor indicates that no or little light is detected in the environment, while the display output provides a known level of detectable light that is emitted into the environment, it can be deduced that the ambient light sensor is obstructed. Otherwise, some of the light from emitted from the display would "leak" and be detectable by the ambient light sensor.

In accordance with some embodiments, an amount of light measured by a first sensor may be compared to an amount of light measured by a second sensor to determine if one of the sensors is obstructed. For example, an ambient light sensor may determine a first value of ambient light while a camera may be used to approximate a second value of ambient light. A greater one of the first value or the second value may be used as a representative value of a true amount of ambient light. In some embodiments, a second sensor (e.g., the camera or other light sensor) may be used intermittently, periodically, or randomly to determine whether the ambient light sensor is obstructed, while minimizing additional power drain caused by use of the second sensor.

An electronic device may include one or more features to assist in a measurement of light generated by a display output. The light may be emitted from the display and/or from a display light, such as a front light or a back light that uses any available technology (e.g., light emitting diodes (LEDs), organic LEDs, etc.). In some embodiments, a feature may project from a housing of the electronic device and reflect at least some light originating from the display or the display light toward an ambient light sensor.

The techniques and systems described herein may be implemented in a number of ways. Example implementations are provided below with reference to the following figures.

FIG. 1 is a schematic diagram of an illustrative electronic device 100 ("the device") usable to detect obstruction of a light sensor. As shown in FIG. 1, the device 100 may be selected from various different electronic devices, individual ones of which include a display. A non-exhaustive list of the devices that may represent the device 100 may include a mobile telephone, a tablet computer, an electronic book (eBook) reader device, notebook computer, a music player, a personal digital assistant (PDA), a netbook computer, a monitor (with or without a television tuner), and so forth. However, virtually any other type of electronic display device may be used that includes a light sensor and a display.

As illustrated, the device 100 may include electronic device subsystems 102. In some embodiments, the subsystems 102 include computer-readable media 104 and one or more processors 106. The processor(s) 106 interact with the computer-readable media 104 to facilitate operation of the device 100. The computer-readable media 104, meanwhile, may be used to store data 108, such as data files, audio and/or video media, eBooks, or the like. The computer-readable media 104 may also include software programs or other executable modules 110 that may be executed by the processor(s) 106. Examples of such programs or modules include off-the-shelf and/or custom applications, indexing modules for indexing data, reader programs, control modules (e.g., power management), network connection software, an operating system, sensor algorithms, and the like.

The subsystems 102 may include a display driver 112, which may use one or more algorithms to cause rendering of a visual representation of content (e.g., text, images, etc.) on a display 114 based on a measured level of ambient light and/or other inputs (e.g., user input, temperature input, etc.). In some embodiments, the display driver 112 may adjust the display settings (e.g., contrast, font size, etc.) based on a measured light intensity of ambient light to improve the visibility the content. In addition or in an alternative, the display driver 112 may adjust lights 116 of the display, possibly by adjusting an amount of light emitted by front lights or back lights associated with the display 114.

In accordance with various embodiments, the subsystems 102 may include an ambient light sensor 118 to measure light intensity of ambient light in an environment. The ambient light sensor 118 may collect luminosity information of the current environment. The ambient light sensor 118 may be any optical sensor that can capture light and convert the captured light into a signal that can be analyzed to determine a measurement of ambient light as an ambient light value. The ambient light sensor 118 may be a dedicated device for measuring ambient light (e.g., outputs a single value that indicates the ambient light value) and/or may be a general purpose optical device used for multiple purposes, such as a camera, which can capture imagery and also enable measurement of ambient light from the captured imagery. The ambient light sensor 118 may generate a signal after a user command (e.g., a command to turn a page in an eBook, refresh a page, etc.), after a periodic or random duration of time, and/or after other events or commands. The signal may be received by the display driver 112, which may interpret the signal and adjust the display 114 and/or the lights 116 according to the measured light intensity. As discussed above, the ambient light sensor 118 may be obscured (blocked, covered, etc.) at times, such as by a finger of a user of the device, by a cover, by dirt, by shadows, and/or by other objects. In such instances, a module may identify an occurrence of the obstruction, as discussed in greater detail below. The module may then at least temporarily implement corrective action, such as by temporarily disabling the ambient light sensor 118, temporarily using light sensor values from other light sensors (e.g., cameras of the device 100, etc.), and/or by notifying a user to take corrective action via a message, alert, or other indicator, which may be visual, audible, haptic, or provided by other means.

In some embodiments, the subsystems 102 may include one or more cameras 120. For example, the device 100 may be equipped with a front facing camera, which may face a user while the user is viewing content on the display 114, and a rear facing camera, which may be located on a side opposite of the device 100 from the side having the front facing camera. More or fewer cameras may be used. The cameras 120 may be virtually any type of light sensing devices, which may sense visible light, non-visible light, or both. For example, the cameras 120 may include an infrared camera, a thermal camera, and/or other types of light sensors or imaging sensors. The cameras 120 may be capable of measuring ambient light in order to facilitate a comparison of values with the ambient light sensor and/or being used to generate an ambient light value when the ambient light sensor is determined to be obscured. Thus, the cameras 120 may be used to determine when the ambient light sensor is obscured and/or used in lieu of the ambient light sensor, at least temporarily, to provide a measurement of ambient light in an environment.

Figure 2:
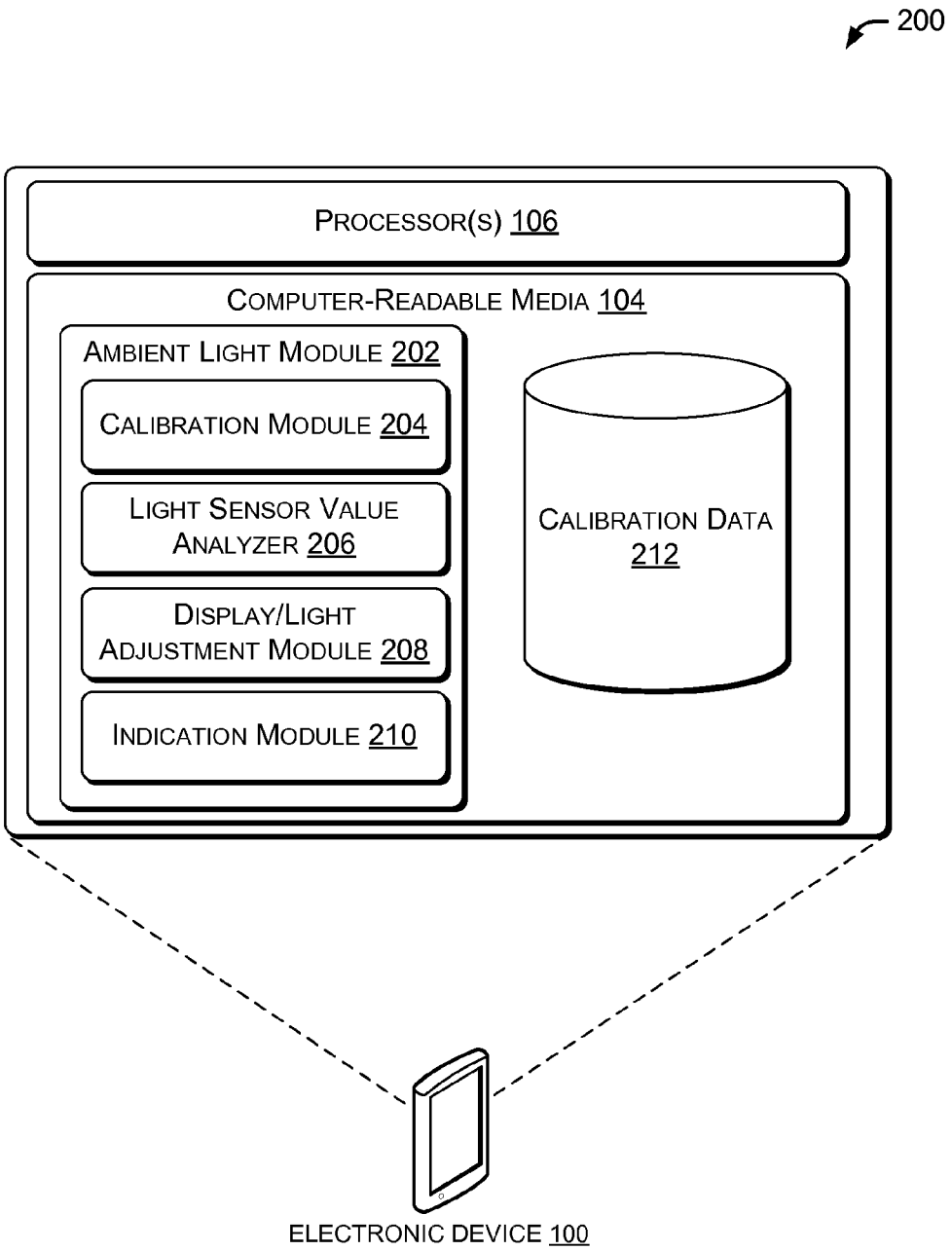
FIG. 2 is a block diagram of an illustrative computing architecture usable to detect obstruction of a light sensor.

FIG. 2 is a block diagram of an illustrative computing architecture 200 usable to detect obstruction of a light sensor. In some embodiments, the computing architecture 200 may be at least partly stored by the computer-readable media 104 and executed by the one or more processors 106. In various embodiments, the computing architecture 200 may be implemented at least partly in electronic hardware, such as logic boards, which cause performance of various operations described below. For example, instructions may be implemented electronically on a chip to perform operations such as to receive an ambient light signal and process the ambient light signal to determine whether the ambient light sensor is blocked, as discussed here.

Embodiments may be provided as a computer program product including a non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of media/machine-readable medium suitable for storing electronic instructions. Further, embodiments may also be provided as a computer program product including a transitory machine-readable signal (in compressed or uncompressed form). Examples of machine-readable signals, whether modulated using a carrier or not, include, but are not limited to, signals that a computer system or machine hosting or running a computer program can be configured to access, including signals downloaded through the Internet or other networks. For example, distribution of software may be by an Internet download.

In some embodiments, the computer-readable media 104 may store an ambient light module 202. The ambient light module 202 may include a calibration module 204, a light sensor value analyzer 206 ("the value analyzer 206"), a display/light adjustment module 208 ("the adjustment module 208"), and an indication module 210, each described in turn. The computer-readable media 106 may also include calibration data 212.

The calibration module 204 may be used to calibrate detection of light by a light sensor, such as by the ambient light sensor 218, based on light emitted by the display 114 and/or the lights 116 of the display. For example, the calibration module 204 may be used to create the calibration data 212 that includes different intensity values of light received by a light sensor for different light emitting outputs for the display 114 and/or the lights 116 of the display. The calibration data 212 may be captured when the device 110 is tested in a dark environment and the display 114 and/or the lights 116 of the display cycle through some or all of the different light emitting outputs, such as by progressively cycling up power of the lights 116 from a minimum level to a maximum level. The calibration data typically follows a substantially linear relationship between the output of the display 114 and/or the lights 116 as compared to the amount of light received by the ambient light sensor 118 or other light sensor. The calibration data may be used by the value analyzer 206 as discussed below.

The value analyzer 206 may measure a change in an amount of light measured by the ambient light sensor 118 or another light sensor during or resulting from a change in the output settings of the display 114 and/or the lights 116. This measured change in the amount of light may be compared to the calibration data to determine whether the measured change is within a threshold range of an expected change based on an increase or decrease in the output of the display 114 and/or the lights 116. The value analyzer 206 may determine whether the ambient light sensor 118 or another light sensor is obscured based on the comparison. For example, when the measured change is outside of the threshold range, the value analyzer 206 may determine that the light sensor is obscured (blocked, covered).

The value analyzer 206 may compare measured values of different light sensors, such a measured value form the ambient light sensor 118 to a measured value from one or more of the cameras 120. The value analyzer 206 may convert information captured by a camera or other image sensor, optical sensor, etc. to approximate an ambient light sensor measurement that is comparable to a form of output by the ambient light sensor 118. For example, the information captured by the camera may be analyzed to evaluate a gain, a histogram, a current exposure level, and/or other information that may be used individually or in any combination to approximate an ambient light value.

In some embodiments, the value analyzer may compare an output setting of the display 114 and/or the lights 116 to an actual amount of light measured by a light sensor. When the amount of light measured by the light sensor is less than an expected amount, then the light sensor may be assumed to be obscured. For example, when the output setting of the lights 116 indicates that the lights are illuminated at full power while no amount of light is captured by the light sensor, then the value analyzer may determine that the light sensor is obscured, otherwise some of the light emitted by the lights 116 would be detectable by the light sensor.

The adjustment module 208 may be used to adjust the output of the display 114 and/or the lights 116 of the display. For example, the adjustment module 208 may cause a change in an amount of power output to the lights 116, which may increase or decrease an intensity of light emitted by the lights 116. This light may be used as a front light or back light that at least partially illuminates the display 114. In some embodiments, the adjustment module 208 may adjust a colorization of the display, which may result in a change in an amount of light emitted from the display and measureable by the ambient light sensor 118 or other light sensor. For example, when the colorization of the display changes from a black or dark colorization (e.g., blue, violet, etc.) to a white or bright colorization (e.g., yellow, orange, etc.), than an amount of light received by the ambient light sensor may increase, assuming the ambient light sensor is not obscured. In some embodiments, the adjustment module 208 may adjust the output of the display 114 and/or the lights 116 of the display based at least in part on measured light received by the ambient light sensor or another light sensor. For example, when the device 100 is moved to a dark room, the adjustment module 208 may determine, based on measured light intensity values from the ambient light sensor, to increase an output settings of the display 114 and/or the lights 116 so that the content on the display is more visible to a user when the device 100 is located in the dark room. In some instances, the adjustment module 208 may make incremental adjustments to the output settings of the display 114 and/or the lights 116 of the display to allow a determination of whether the ambient light sensor 118 is obscured, as discussed more fully below.

The indication module 210 may be used to communicate and/or indicate a state of the ambient light sensor as obscured or not obscured. For example, the indication module 210 may output a message via a user interface, cause a sound to be emitted, cause a haptic or tactile feedback output, or cause other user-perceivable output in response to a determination that the ambient light sensor or another light sensor is obscured. The indication may prompt a user to take corrective action, and thus move an object that obscures the respective light sensor.

The operation of the ambient light module 202 and respective sub-modules are further described in the illustrative operations provided below.

Figure 3:
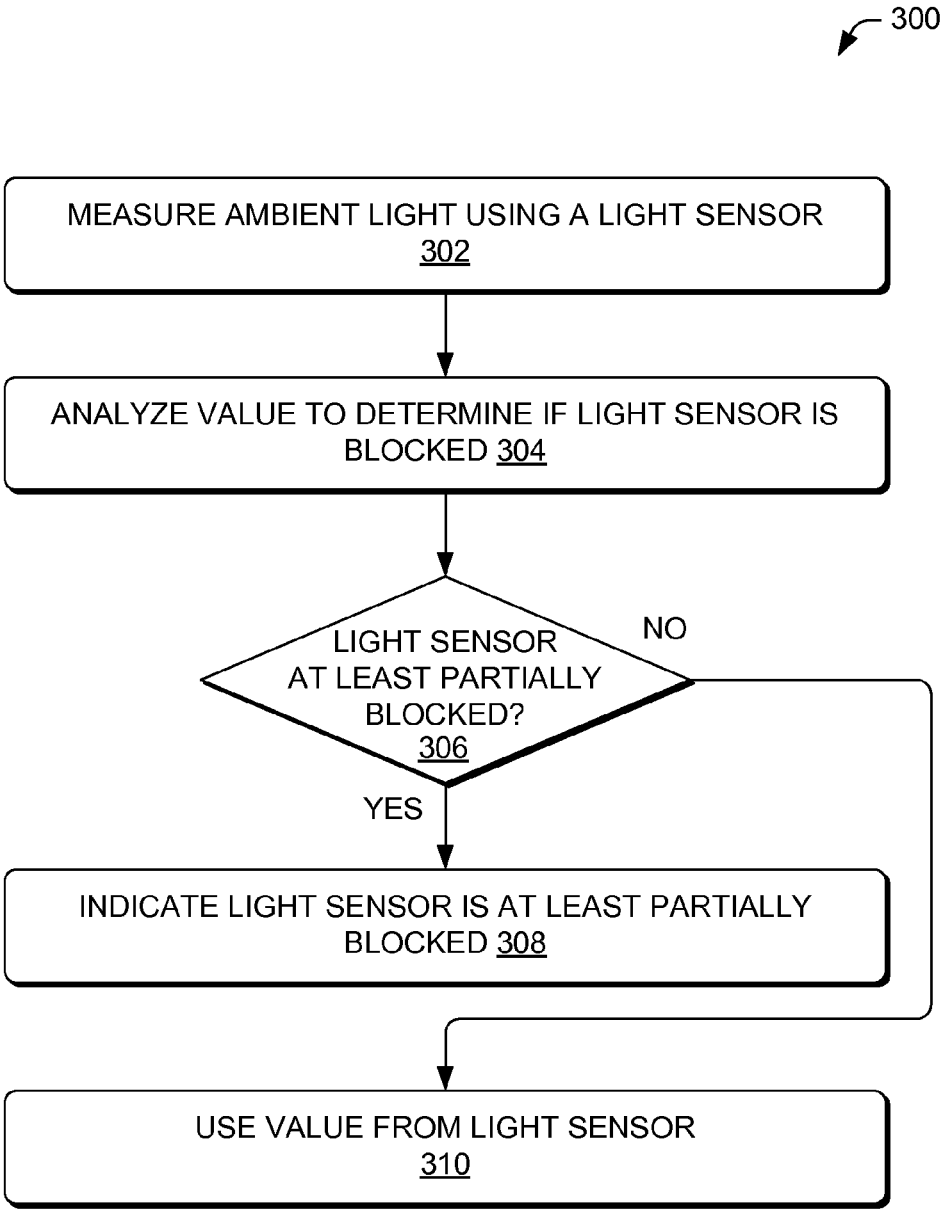
FIG. 3 is a flow diagram of an illustrative process to measure ambient light and determine whether a light sensor is obstructed based at least in part on the measurement.

FIG. 3 is a flow diagram of an illustrative process 300 to measure ambient light and determine whether a light sensor is obstructed based at least in part on the measurement. The process 300 is illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process. The process 300 is described with reference to illustrative device 100 and the illustrative computing architecture 200. Of course, the process 300 may be performed in other similar and/or different devices, architectures, and/or environments.

At 302, a light sensor may measure ambient light. The light sensor may be the ambient light sensor 118, one of the cameras 120 and/or other light sensors configured to operate with the device 100. In some embodiments, the measurement of the ambient light may include processing information received by the light sensor, such as analyzing an output to evaluate a gain, a histogram, a current exposure level, and/or other information which may be used individually or in any combination to approximate an ambient light value.

At 304, the value analyzer 206 may analyze a value representative of the measured ambient light to determine whether the light sensor is blocked. The value analyzer 206 may employ various techniques to make such a determination. For example, the value analyzer 206 may compare values from other light sensors to determine whether at least one of the light sensors measures significantly less light than another light sensor. As another example, the value analyzer 206 may compare the value to an expected value based on a known output of the display 114 and/or the lights 116 of the display. As yet another example, the value analyzer 206 may compare a change in ambient light to an expected change in the ambient light after an adjustment to the output settings of the display 114 and/or the lights 116 of the display. These various techniques are discussed in further detail below with reference to at least FIGS. 5-8.

At 306, the value analyzer 206 may determine whether the light sensor is at least partially blocked. When the light sensor is determined to be at least partially blocked (following the "yes" route from the decision operation 306), then the process 300 may advance to an operation 308.

At 308, the value analyzer 206 may indicate that the light sensor is at least partially blocked. The indication may or may not be communicated to the user. When the indication is to be communicated to the user, then the value analyzer 206 may cause the indication module 210 to indicate that the light sensor is at least partially blocked. The indication may also be used to at least temporarily disable use of the blocked light sensor, at least temporarily use a substitute light sensor (e.g., one of the cameras 120, etc.), delay adjustment of display settings, refrain from adjustment of display settings, and/or take other action.

When the light sensor is determined not to be at least partially blocked (following the "no" route from the decision operation 306), then the process 300 may advance to an operation 310. At 310, the value analyzer may use the value from the light sensor since the light sensor is determined not to be blocked. The value may be used by the adjustment module 208 to adjust an output setting of the display 114 and/or the lights 116 of the display, thereby improving a user experience during interaction with the device 100.

In accordance with some embodiments, the decision 306 may be based at least in part on determining a difference between the first ambient light measurement and the second ambient light measurement and determining a difference in an amount of internal light leakage from the display that occurs between output of the initial brightness level and output of the intermediate brightness level. In some embodiments, the internal light leakage may be light that reaches the ambient light sensor from the display through a cover glass of the display. For example, the ambient light sensor and the display may both be located under a same cover glass or a cover formed of one or more other materials. The process may then determine that the ambient light sensor is at least partially blocked in response to the ambient light measurement difference being less than an expected difference that is determined from a lookup table of calibration data based on the difference in the amount of internal light leakage.

Figure 4:
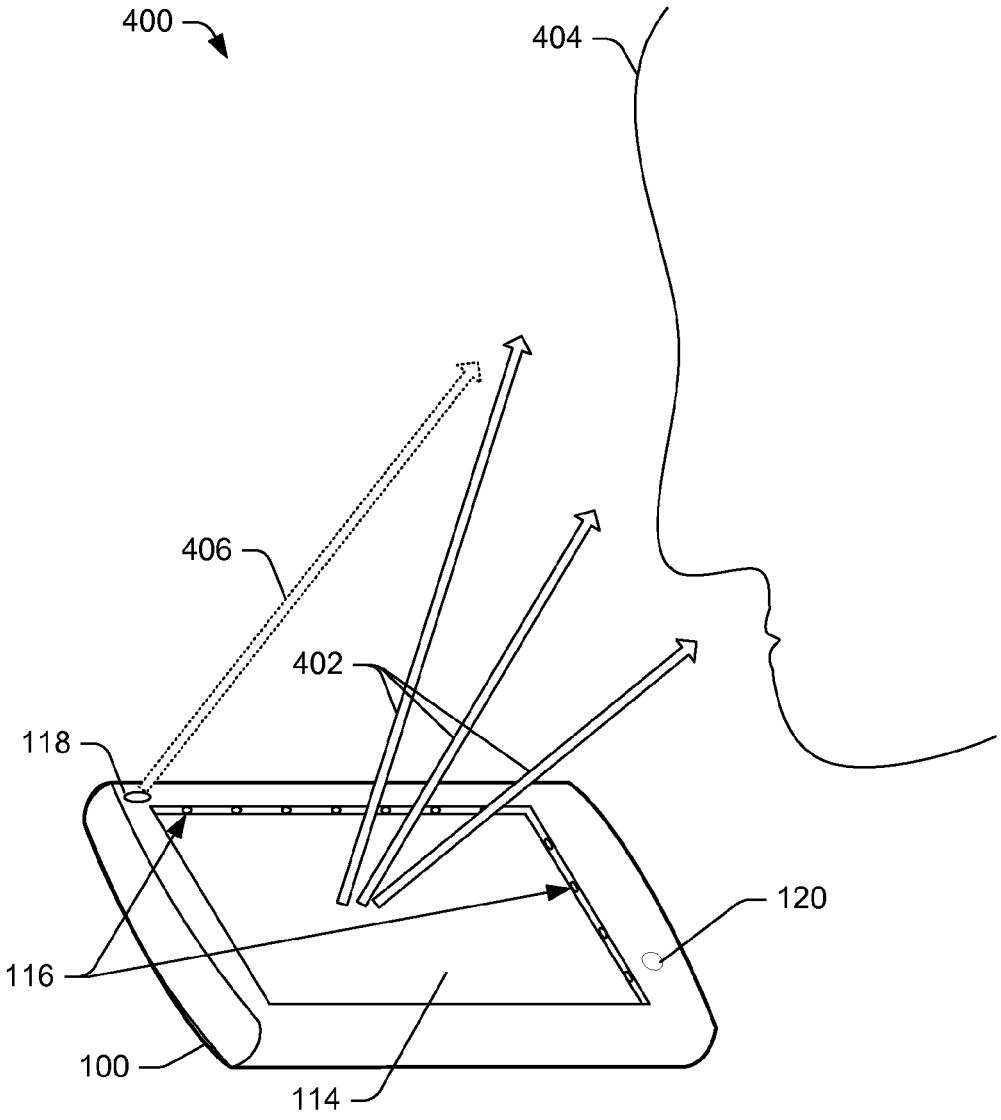
FIG. 4 is a schematic diagram showing an environment depicting illumination of a surface from a light source, where the light source is at least partially adjusted based on measured ambient light by an ambient light sensor, the measured ambient light including light reflected from the surface.

FIG. 4 is a schematic diagram showing an environment 400 depicting illumination of a surface from a light source, where the light source is at least partially adjusted based on measured ambient light by an ambient light sensor, the measured ambient light including light reflected from the surface.

As shown in the environment 400, the device 100 may emit light 402 from the display 114 and/or from the lights 116 of the display. The emitted light 402 may project outward and away from the display 114 and device 100. The emitted light 402 may illuminate a surface 404 of an object, such as a face of a user, a wall, a portion of the bezel of the device 100, and/or other surfaces of other objects.

Meanwhile, the ambient light sensor 118 may measure ambient light 406 in the environment 400. For example, the ambient light sensor 118 may measure a portion of the light reflected from the surface 404, where at least a portion of that light originated from the display 114 and/or the lights 116 of the display. Thus, as the output settings of the display 114 and/or the lights 116 changes (is adjusted by the adjustment module 208), then the amount of light measured by the ambient light sensor 118 (or other light sensor) may change. This change may be predictable based on the calibration data 212 that correlates changes in the output settings of the display 114 and/or the lights 116 to changes in the measurement of the ambient light. By measuring the ambient light, adjusting the output of the display/lights, and then measuring the ambient light again, the value module 206 may determine a change in the ambient light for a change in the output of the display/lights. A comparison of these changes (values) may indicate whether the ambient light sensor is obscured.

FIGS. 5-8 are illustrative processes illustrated as a collection of blocks in a logical flow graph, which represent a sequence of operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes.

Figure 5:
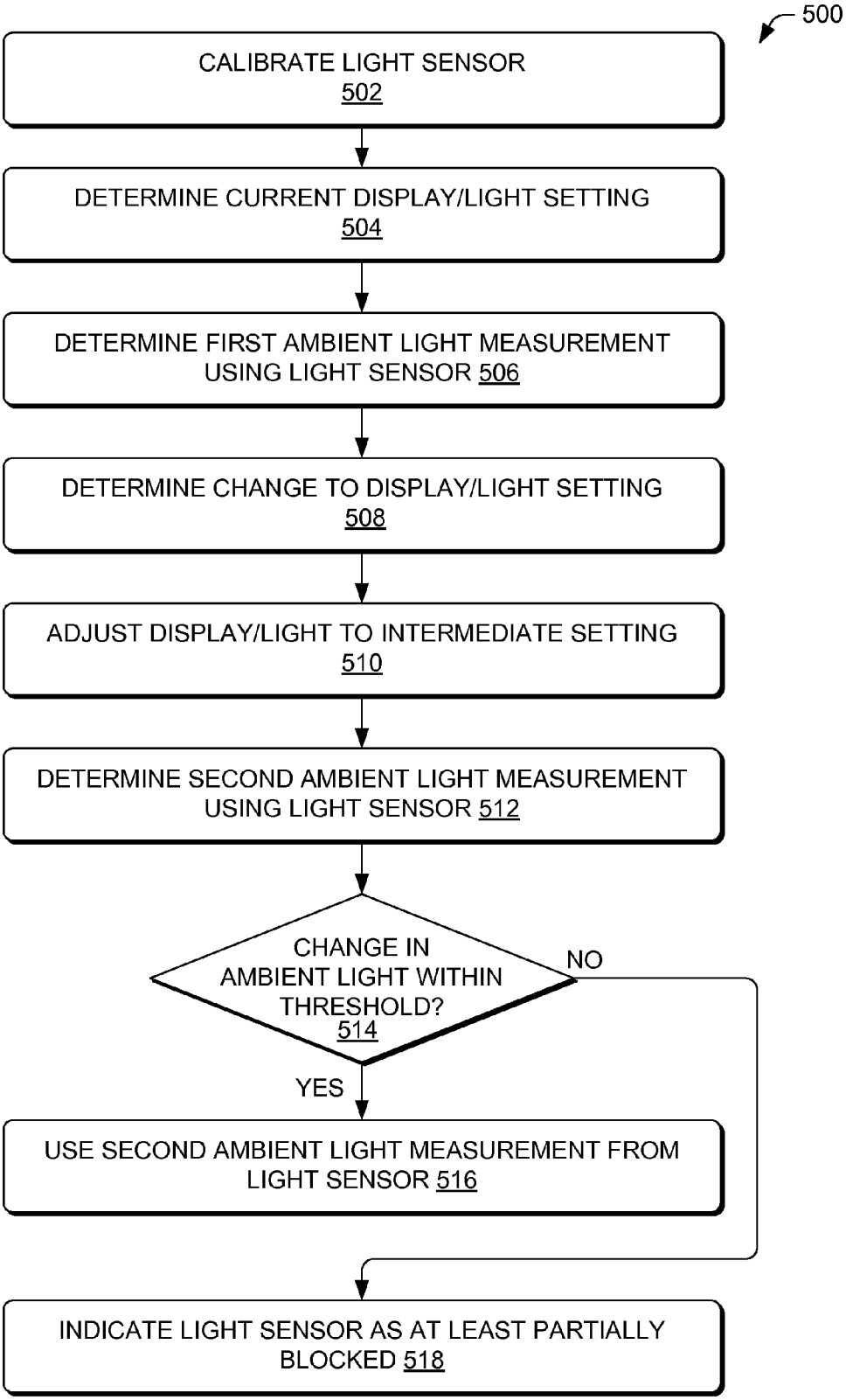
FIG. 5 is a flow diagram of another illustrative process to measure ambient light and determine whether a light sensor is obstructed based at least in part on the measurement.

FIG. 5 is a flow diagram of an illustrative process 500 to measure ambient light and determine whether a light sensor is obstructed based at least in part on the measurement. The process 500 is described with reference to illustrative device 100 and the illustrative computing architecture 200. Of course, the process 500 may be performed in other similar and/or different devices, architectures, and/or environments.

At 502, the calibration module 204 may be used to create the calibration data 212, which may be used by the value analyzer 206 to determine whether a light sensor is obscured. The calibration may be performed by operating the device 100 in an environment with a consistent level of light, such as a dark room with little or no ambient light. The calibration may then measure and record changes or amounts of ambient light measured for various output settings of the display 114 and/or the lights 116 of the display.

At 504, the value analyzer 206 may determine a current setting of the output of the display 114 and/or the lights 116. This current setting may be compared to a value stored in the calibration data 212.

At 506, the value analyzer 206 may determine a first ambient light measurement using the light sensor, such as the ambient light sensor 118. For example, the value analyzer 206 may receive or access a signal from the light sensor that indicates the measured value of ambient light that was measured within a threshold amount of time since the performance of the operation 504.

At 508, the adjustment module 208 may determine a change to the output settings of the display 114 and/or the lights 116 based at least in part on the measured ambient light from the operation 506. Thus, the adjustment module 208 may determine a revised output setting. For example, if the measured ambient light indicates an increase in light, the adjustment module 208 may decrease an output of the lights 116 or take other action.

At 510, the adjustment module 208 may adjust the output of the display 114 and/or the lights 116 to an intermediate output setting that may be less than the revised output setting determined at the operation 508. The adjustment module 208 may use any intermediate output setting between the output setting determined at the operation 504 and the output setting determined at the operation 508 or the adjustment module 208 may use the output setting determined at the operation 508. In some embodiments, the intermediate output setting may be approximately a mid-range output setting between the respective outputs settings. Use of an intermediate output setting that is different than the output setting determined at the operation 508 may allow a minimized change to the output of the display 114 and/or the lights 116, which if incorrect (e.g., in response to measured ambient light from an at least partially obscured light sensor), may cause minimal or no disruption to a user experience while a user operates the device 100.

At 512, the value analyzer 206 may determine a second ambient light measurement using the light sensor. The operation 512 may be performed in a similar manner as the operation 506, and within a threshold amount of time since the performance of the operation 510.

At 514, the value analyzer 206 may determine whether a change in the ambient light is detected using the measurements from the operations 506 and 512. The change may be compared to an expected change or specified change that includes use of the calibration data 212. For example, the change may be analyzed to be within a threshold variance of an expected or specified change, where the expected change is calculated by adding or subtracting from the first ambient light measurement a corresponding amount from the calibration data 212 associated with the change from the operation 510. When the change in the ambient light is within a threshold range of values calculated using the calibration data 212 (following the "yes" route from the decision operation 514), then the process 500 may advance to an operation 516.

At 516, the value analyzer 206 may determine to use the second ambient light measurement from the light sensor. This value may be used by the adjustment module 208 to adjust the output settings of the display 114 and/or the lights 116 of the display to the revised output setting determined at the operation 508 when the revised output setting has not yet been implemented due to use of an intermediate output setting at the operation 510.

When the change in the ambient light is not within the threshold range of values calculated using the calibration data 212 (following the "no" route from the decision operation 514), then the process 500 may advance to an operation 518. At 518, the value analyzer 206 may indicate that the light sensor is at least partially blocked. The indication may or may not be communicated to the user. When the indication is to be communicated to the user, then the value analyzer 206 may cause the indication module 210 to indicate that the light sensor is at least partially blocked. The indication may also be used to at least temporarily disable use of the blocked light sensor, at least temporarily use a substitute light sensor (e.g., one of the cameras 120, etc.), and/or take other action.

Figure 6:
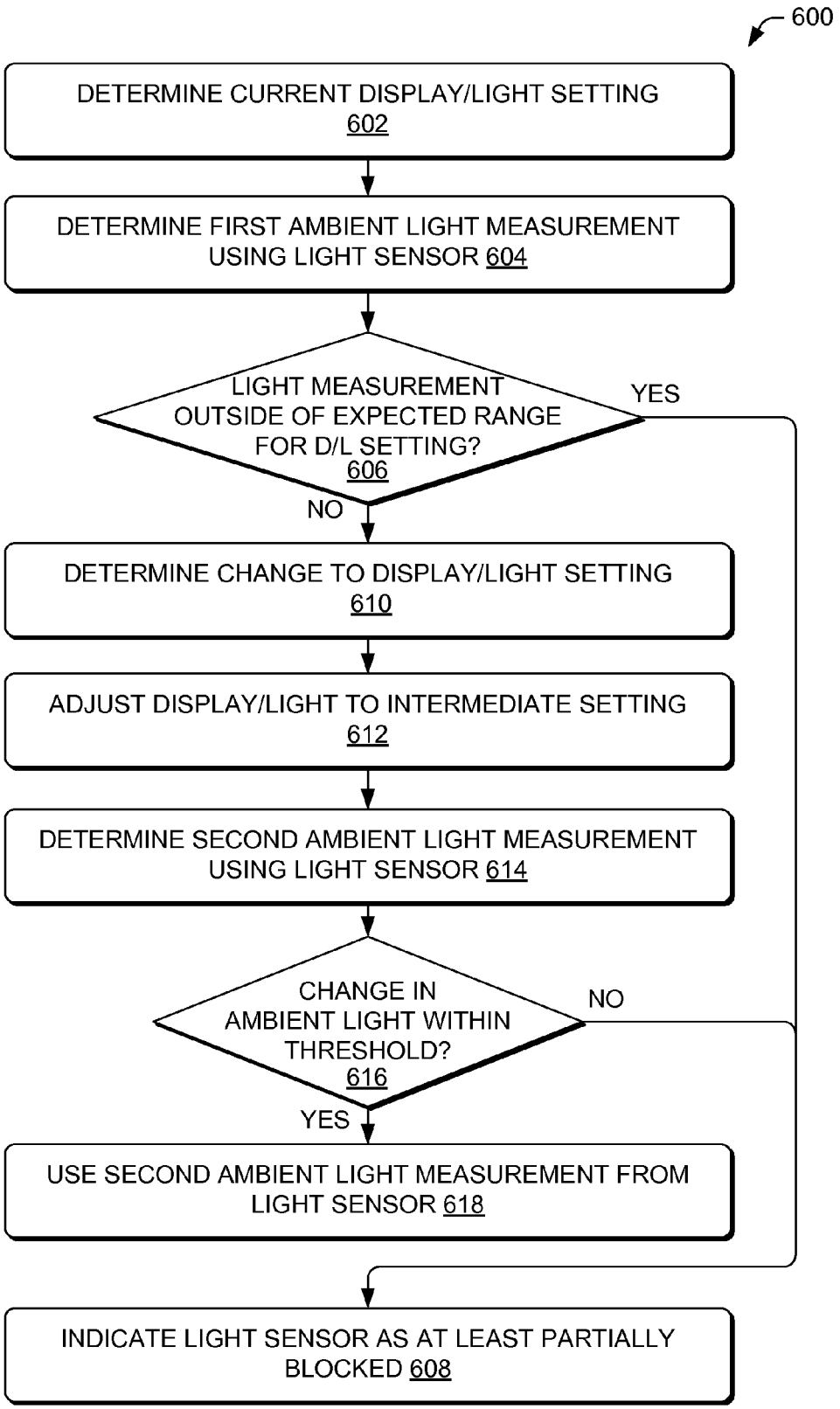
FIG. 6 is a flow diagram of yet another illustrative process to measure ambient light and determine whether a light sensor is obstructed based at least in part on the measurement.

FIG. 6 is a flow diagram of yet another illustrative process 600 to measure ambient light and determine whether a light sensor is obstructed based at least in part on the measurement. The process 600 is described with reference to illustrative device 100 and the illustrative computing architecture 200. Of course, the process 600 may be performed in other similar and/or different devices, architectures, and/or environments.

At 602, the value analyzer 206 may determine a current setting of the output of the display 114 and/or the lights 116. This current setting may be compared to a value stored in the calibration data 212.

At 604, the value analyzer 206 may determine a first ambient light measurement using the light sensor, such as the ambient light sensor 118. For example, the value analyzer 206 may receive or access a signal from the light sensor that indicates the measured value of ambient light that is measured within a threshold amount of time since the performance of the operation 602.

At 606, the value analyzer 206 may determine if the first ambient light measurement from the operation 604 is outside of a threshold range expected for a particular output of the display 114 and/or the lights 116 of the display determined at the operation 602. For example, if the output of the display and/or lights is a relatively high output (e.g., the lights 116 are near full power, etc.), and the first ambient light measurement indicates little or no ambient light, than the comparison may indicate that the ambient light sensor is obscured. The threshold range may be based at least in part on the calibration data 212, which may indicate an expected value or value range of the measured ambient light for a given output of the display 114 and/or the lights 116 of the display. However, it is noted that this initial test may have limited applicability and may only apply in limited situations based on values of the output settings of the display/lights and the measured amount of ambient light.

When the measurement is outside of the expected range for the output of the display/lights (following the "yes" route from the decision operation 606), then the process 600 may advance to an operation 608. At 608, the value analyzer 206 may indicate that the light sensor is at least partially blocked. The indication may or may not be communicated to the user. When the indication is to be communicated to the user, then the value analyzer 206 may cause the indication module 210 to indicate that the light sensor is at least partially blocked. The indication may also be used to at least temporarily disable use of the blocked light sensor, at least temporarily use a substitute light sensor (e.g., one of the cameras 120, etc.), and/or take other action.

When the measurement is not outside of the expected range for the output of the display/lights (following the "no" route from the decision operation 606), then the process 600 may advance to an operation 610. At 610, the adjustment module 208 may determine a change to the output setting of the display 114 and/or the lights 116 based at least in part on the measured ambient light from the operation 604. Thus, the adjustment module 208 may determine a revised output setting. For example, if the measured ambient light indicates an increase in light, the adjustment module 208 may decrease an output of the lights 116 or take other action.

At 612, the adjustment module 208 may adjust the output of the display 114 and/or the lights 116 to an intermediate output setting that may be less than the revised output setting determined at the operation 610. The adjustment module 208 may use any intermediate output setting between the output setting determined at the operation 602 and the output setting determined at the operation 610 or the adjustment module 208 may use the output setting determined at the operation 610. In some embodiments, the intermediate output setting may be approximately a mid-range output setting between the respective outputs settings. Use of an intermediate output setting that is different than the output setting determined at the operation 610 may allow a minimized change to the output of the display 114 and/or the lights 116, which if incorrect (e.g., in response to measured ambient light from an at least partially obscured light sensor), may cause minimal or no disruption to a user experience while a user operates the device 100.

At 614, the value analyzer 206 may determine a second ambient light measurement using the light sensor. The operation 614 may be performed in a similar manner as the operation 604, and within a threshold amount of time since the performance of the operation 612.

At 616, the value analyzer 206 may determine whether a change in the ambient light is detected using the measurements from the operations 604 and 614. The change may be compared to an expected change that includes use of the calibration data 212. For example, the change may be analyzed to be within a threshold variance of an expected change, where the expected change is calculated by adding or subtracting from the first ambient light measurement a corresponding amount from the calibration data 212 associated with the change from the operation 612. When the change in the ambient light is within a threshold range of values calculated using the calibration data 212 (following the "yes" route from the decision operation 616), then the process 600 may advance to an operation 618.

At 618, the value analyzer 206 may determine to use the second ambient light measurement from the light sensor. This value may be used by the adjustment module 208 to adjust the output of the display 114 and/or the lights 116 of the display to the revised output setting determined at the operation 610 when the revised output setting has not yet been implemented due to use of an intermediate output setting at the operation 612.

When the change in the ambient light is not within the threshold range of values calculated using the calibration data 212 (following the "no" route from the decision operation 616), then the process 600 may advance to the operation 608, which is described above.

Figure 7:
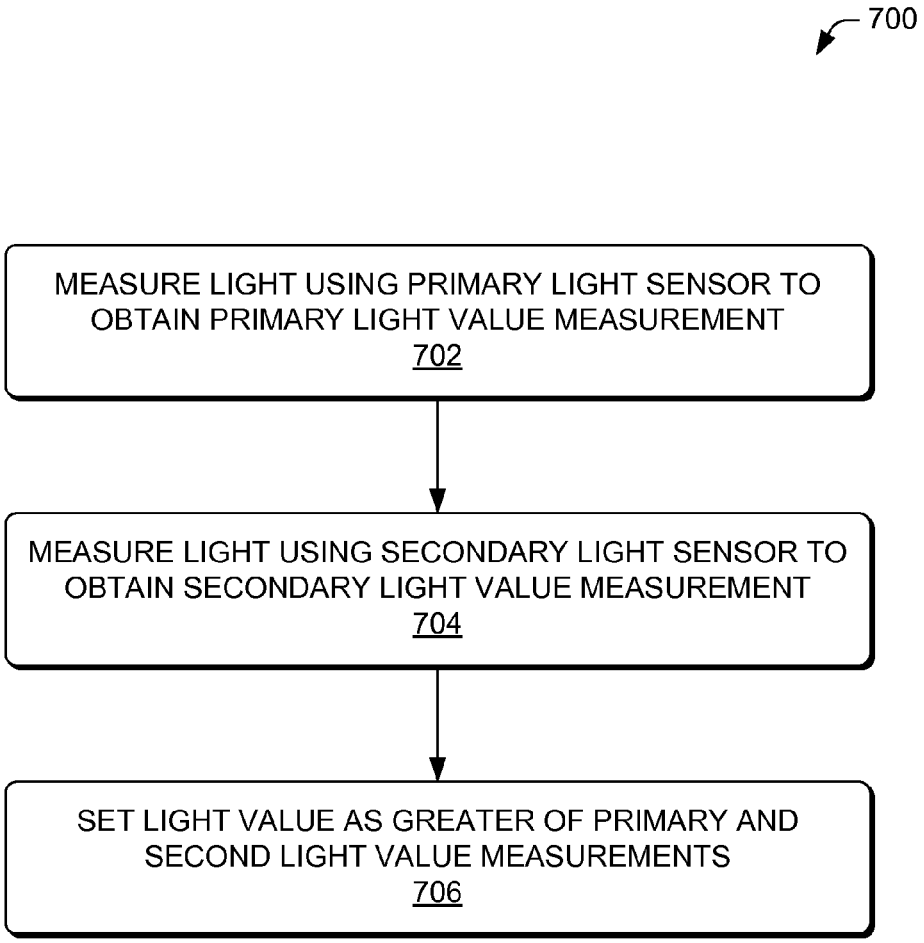
FIG. 7 is a flow diagram of an illustrative process to compare measurements of light received by different light sensors to select one of the measurements of light as representative of a true value of ambient light.

FIG. 7 is a flow diagram of an illustrative process 700 to compare measurements of light received by different light sensors to select one of the measurements of light as representative of a true value of ambient light. The process 700 is described with reference to illustrative device 100 and the illustrative computing architecture 200. Of course, the process 700 may be performed in other similar and/or different devices, architectures, and/or environments.

At 702, the value analyzer 206 may determine a primary ambient light measurement that is measured by a primary light sensor. The primary light sensor may be the ambient light sensor 118.

At 704, the value analyzer 206 may determine a secondary ambient light measurement that is measured by a secondary light sensor. The secondary light sensor may be one of the cameras 120. A selected camera may be a camera located on a same surface of the device 100 as the location of the ambient light sensor 118. The secondary light measurement may be measured within a predetermined threshold amount of time from the measurement of the primary light measurement at the operation 702, such as a substantially same time.

At 706, the value analyzer 206 may set the ambient light value as the greater of the primary ambient light measurement and the secondary ambient light measurement. For example, when the primary ambient light measurement is significantly less than the secondary ambient light measurement, this may indicate that the primary light sensor is obscured. Thus, the value from the primary light sensor may not be desirable at this time.

In some embodiments, additional light sensors may be used, such as a third light sensor. When three or more light sensors are used, the comparison may randomly select values from different light sensors such that all light sensors are not used for each iteration, thereby possibly reducing power consumption by the device 100.

Figure 8:
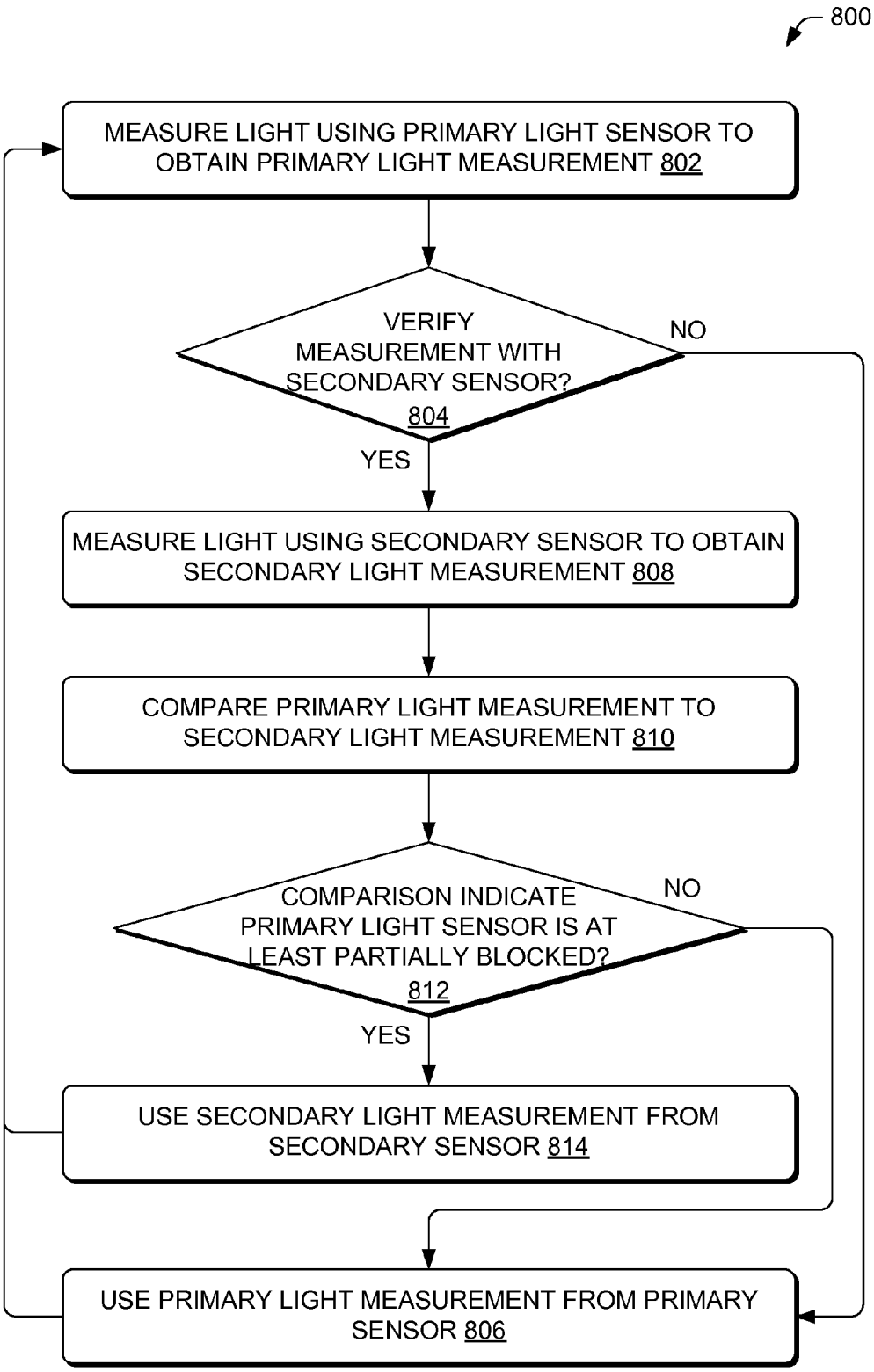
FIG. 8 is a flow diagram of another illustrative process to compare measurements of light received by different light sensors to select one of the measurements of light as representative of a true value of ambient light.

FIG. 8 is a flow diagram of another illustrative process 800 to compare measurements of light received by different light sensors to select one of the measurements of light as representative of a true value of ambient light. The process 800 is described with reference to illustrative device 100 and the illustrative computing architecture 200. Of course, the process 800 may be performed in other similar and/or different devices, architectures, and/or environments. The process 800 may be employed to reduce consumption of power during operation of the device 100.

At 802, the value analyzer 206 may determine a primary ambient light measurement that is measured by a primary light sensor. The primary light sensor may be the ambient light sensor 118.

At 804, the value analyzer 206 may determine whether or not to check or verify the primary ambient light measurement against a secondary ambient light measurement obtained using at least a secondary sensor. The determination may be based on an elapsed time between a last verification, a random selection of the verification, a response to a user action or selection, and/or prompted by other events or actions. When the value analyzer 206 determines not to perform a verification (following the "no" route from the decision operation 804), then the process 800 may advance to an operation 806. At 806, the value analyzer 206 may indicate use of the primary ambient light measurement, which may be used by the adjustment module 208 to adjust an output setting of the display 114 and/or the lights 116 of the display.

When the value analyzer 206 determines to perform a verification (following the "yes" route from the decision operation 804), then the process 800 may advance to an operation 808. At 808, the value analyzer 206 may determine a secondary ambient light measurement that is measured by a secondary light sensor. The secondary light sensor may be one of the cameras 120. A selected camera may be a camera located on a same surface of the device 100 as the location of the ambient light sensor 118. The secondary light measurement may be measured within a predetermined threshold amount of time from the measurement of the primary light measurement at the operation 802.

At 810, the value analyzer 206 may compare the primary light measurement of the secondary light measurement 810 to determine whether the measurements are different by more than a threshold amount.

At 812, the value analyzer 206 may determine whether the comparison from the operation 810 indicates that the primary light sensor is at least partially blocked. For example, the primary light sensor may be determined to be at least partially blocked in response to a determination that the primary ambient light measurement from the operation 802 is lower than the secondary ambient light measurement from the operation 808 by an amount greater than the threshold amount. When the value analyzer 206 determines that the primary light sensor is at least partially blocked (following the "yes" route from the decision operation 812), then the process 800 may advance to an operation 814.

At 814, the value analyzer may use the value from the secondary light source. For example, the value analyzer 206 may cause the adjustment module 208 to use the secondary ambient light value to cause a change in the output setting of the display 114 and/or the lights 116 of the display.

When the value analyzer 206 determines that the primary light sensor is not at least partially blocked (following the "no" route from the decision operation 812), then the process 800 may advance to the operation 806, which is described above.

Figure 9:
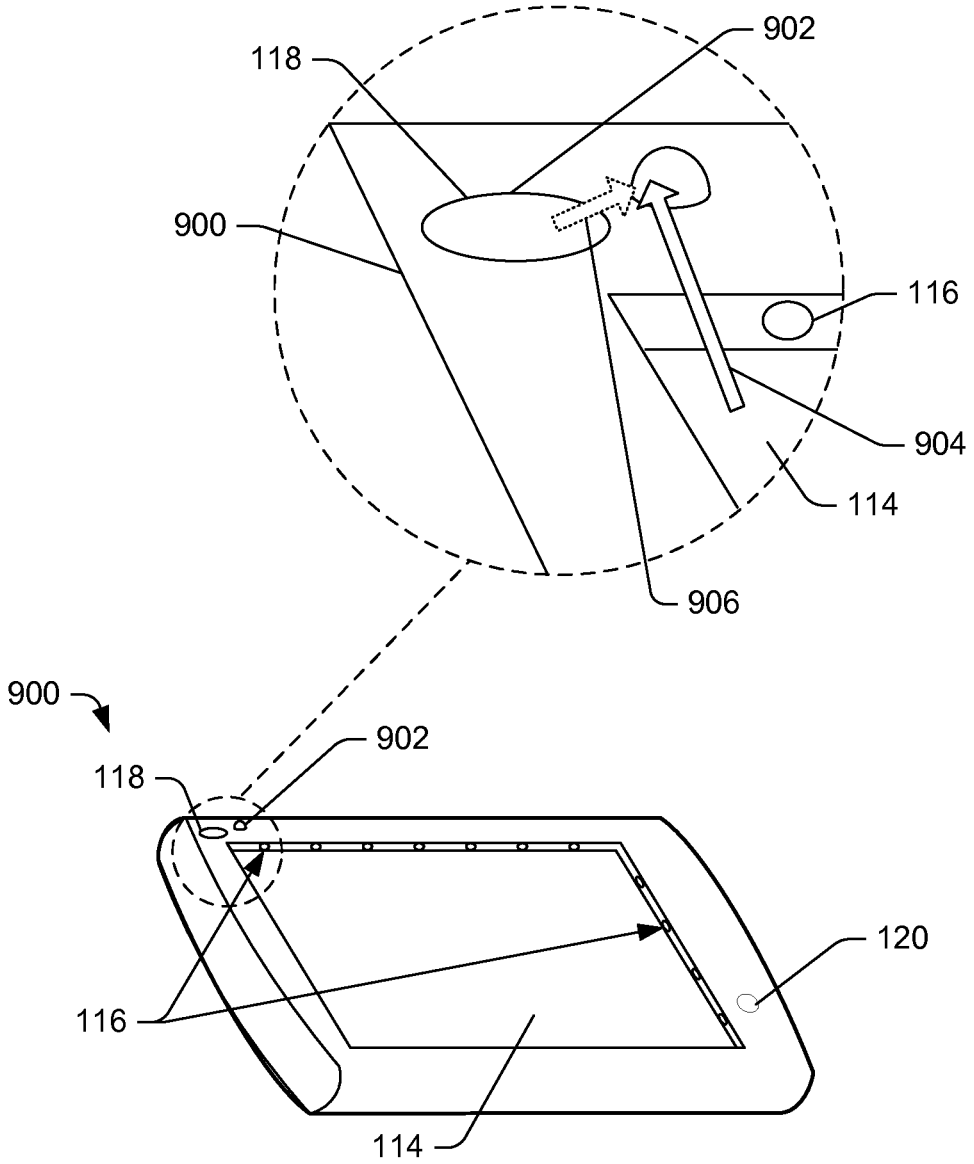
FIG. 9 is an illustrative device that includes a light reflecting feature that reflects at least some light originating from a display or a display light toward an ambient light sensor.

FIG. 9 is an illustrative device 900 that includes a light reflecting feature that reflects at least some light originating from a display or a display light toward an ambient light sensor. The device 900 may be a same or similar device at the device 100 shown in FIGS. 1, 2, and 4. However, the device 900 may include a reflective feature 902 that redirects light from the display 114 and/or the lights 116 of the display to the ambient light sensor 118. The reflective feature may be a protrusion or raised feature that projects beyond the bezel of the device 900, and thereby receives light from the display 114 and/or the lights 116. The reflective feature may be formed as a rounded bump, an angled protruding feature, or any other shape or design that reflects light from the display and/or lights to the ambient light sensor, but allows the ambient light sensor to be obscured by a finger, a device cover, a device case, a device accessory, a piece of paper, dirt, shadow, and/or other objects that may cover the ambient light sensor while allowing at least part of the display 114 to remain visible to a user.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A method comprising:

determining an initial display brightness setting for a display of a device;

determining, using an ambient light sensor, a first ambient light measurement;

determining, using a lookup table, a revised display brightness setting based at least in part on the first ambient light measurement, wherein the revised display brightness setting is different from the initial display brightness setting;

determining an intermediate display brightness setting, the intermediate display brightness setting corresponding to a minimum increase from the initial display brightness setting that causes a specified increase in ambient light measurement;

adjusting a brightness level of the display based on the intermediate display brightness setting;

determining, using the ambient light sensor, a second ambient light measurement upon adjusting the brightness level of the display based on the intermediate display brightness setting;

determining a difference between the first ambient light measurement and the second ambient light measurement;

determining that the difference between the first and the second ambient light measurements is less than the specified increase in the ambient light measurement; and determining that the ambient light sensor is at least partially blocked based at least in part on the determining that the difference between the first and the second ambient light measurements is less than the specified increase in the ambient light measurement.

2. The method as recited in claim 1, further comprising, in response to the determining that the ambient light sensor is at least partially blocked, adjusting the display brightness setting to the initial display brightness setting.

3. The method as recited in claim 1, wherein the intermediate display brightness setting is a midpoint setting that is halfway between the initial display brightness setting and the revised display brightness setting.

4. The method as recited in claim 1, further comprising, in response to the determining that the ambient light sensor is at least partially blocked, causing a message to be displayed to a user to indicate that the ambient light sensor is at least partially blocked.

5. A method comprising:

determining, by an electronic device having a display and a light sensor, a first value corresponding to light received by the light sensor, the light including ambient light and a portion of light emitted by the display;

determining, by the electronic device based at least in part on the first value, that the light sensor is at least partially blocked by adjusting a display setting to a first setting that is determined based on the first value;

determining a second value corresponding to light received by the light sensor after adjusting the display setting to the first setting; and comparing the first and the second values to determine that the light sensor is at least partially blocked; and in response to determining that the light sensor is at least partially blocked, delaying, by the electronic device, at least temporarily, adjustment of the display setting, the display setting being determined based at least in part on the first value.

6. The method as recited in claim 5, wherein determining the first value and determining that the light sensor is at least partially blocked is performed using logic implemented on a logic board in the electronic device.

7. The method as recited in claim 5 wherein adjusting the display setting includes adjusting the display setting by a specified amount that results in a specified change in an output of the light sensor, and wherein comparing the first and the second values further includes determining that a difference between the first and the second values is less than the specified change in the output of the light sensor.

8. The method as recited in claim 5, wherein the light sensor is at least one of an ambient light sensor or a camera.

9. The method as recited in claim 5, wherein the second value is derived from at least one of a gain, a histogram, or a current exposure level of imagery captured by the secondary light sensor.

10. The method as recited in claim 5, further comprising, causing an alert to indicate that the light sensor is at least partially blocked.

11. The method as recited in claim 5, wherein a source of the light emitted by the display is at least one of a front light or a back light of the display.

12. An apparatus comprising:

a light sensor;

a display; and at least one processor to execute instructions that, when executed, cause the apparatus to:

determine a first value corresponding to light received by the light sensor, the light including ambient light and a portion of light emitted by the display;

determine, based at least in part on the first value, that the light sensor is at least partially blocked by:

adjusting a display setting to a first setting that is determined based on the first value;

determining a second value corresponding to light received by the light sensor after adjusting the display output setting to the first setting; and comparing the first value and the second value to determine that the light sensor is at least partially blocked; and in response to determining that the light sensor is at least partially blocked, refrain at least temporarily from adjusting a setting of the display, the setting being based at least in part on the first value.

13. The apparatus as recited in claim 12, wherein adjusting the display setting includes adjusting the display setting by a specified amount that results in a specified change in an output of the light sensor, and wherein comparing the first and the second values further includes determining that a difference between the first and the second values is less than the specified change in the output of the light sensor.

14. The apparatus as recited in claim 12, wherein the light sensor is at least one of an ambient light sensor or a camera.

15. The apparatus as recited in claim 12, wherein the comparing is performed intermittently to reduce power consumption.

16. The apparatus as recited in claim 12, wherein the first value is derived from at least one of a gain, a histogram, or a current exposure level of imagery captured by the light sensor.

* * * * *